US012708816B2

(12) United States Patent
Cessor et al.

(10) Patent No.: US 12,708,816 B2
(45) Date of Patent: Aug. 18, 2026

(54) SWIM GOGGLES

(71) Applicant: NIKE, Inc., Beaverton, OR (US)

(72) Inventors: Susan D. Cessor, Lake Oswego, OR (US); Carrie Abbamonto, Portland, OR (US); Erika Gentry, Portland, OR (US)

(73) Assignee: NIKE, INC., Beaverton, OR (US)

( * ) Notice: Subject to any disclaimer, the term of this patent is extended or adjusted under 35 U.S.C. 154(b) by 0 days.

(21) Appl. No.: 18/918,961

(22) Filed: Oct. 17, 2024

(65) Prior Publication Data

US 2026/0108781 A1 Apr. 23, 2026

(51) Int. Cl.
*A63B 33/00* (2006.01)
*A44B 11/06* (2006.01)

(52) U.S. Cl.
CPC ..... *A63B 33/004* (2020.08); *A44B 11/06* (2013.01)

(58) Field of Classification Search
CPC ..... A44B 11/00; A44B 11/02; A44B 11/06; A44B 11/065; A61F 9/027; A63B 33/002; A63B 33/004; A63B 33/006; A63B 33/008
See application file for complete search history.

(56) References Cited

U.S. PATENT DOCUMENTS 4,607,398 A 8/1986 Faulconer
4,727,630 A 3/1988 Alan
5,467,508 A 11/1995 Feng
5,727,259 A 3/1998 Kawamata
6,215,601 B1 4/2001 Huang
6,219,889 B1 4/2001 Lovato et al.
6,446,272 B1 * 9/2002 Lee ..... A63B 33/004 2/452
6,832,394 B1 * 12/2004 Chiang ..... A63B 33/004 2/452
7,007,311 B2 * 3/2006 Chiang ..... A63B 33/004 2/448
7,020,905 B2 * 4/2006 Chiang ..... A63B 33/004 2/452
7,146,653 B2 12/2006 Chou
7,181,780 B1 * 2/2007 Chiang ..... A63B 33/004 2/440
7,257,848 B2 * 8/2007 Chiang ..... A63B 33/004 2/448
7,275,536 B2 10/2007 Godoy
(Continued)

FOREIGN PATENT DOCUMENTS

EP 0792666 B1 5/1999
EP 1871186 B1 6/2012

OTHER PUBLICATIONS

"EWPJDK Swim Goggles", Amazon, amazon.com, ASIN: B09MHBKFZX, DateFirst Available: Accessed: Jul. 22, 2024. https://www.amazon.com/EWPJDK-Swim-Goggles-Swimming-Leaking/dp/B09MHG4NHV.
(Continued)

*Primary Examiner* — F Griffin Hall
(74) *Attorney, Agent, or Firm* — Bookoff McAndrews LLC

(57) ABSTRACT

Swim goggles with a strap; and an adjustment mechanism. The adjustment mechanism including a body and a frame both together forming an outer casing of the adjustment mechanism, the frame including an actuator and a stop, wherein the strap is routed through the adjustment mechanism.

16 Claims, 5 Drawing Sheets

(56) References Cited

U.S. PATENT DOCUMENTS

| | | | | |
|---|---|---|---|---|
| 7,571,520 | B2 | 8/2009 | Shiue | |
| 7,631,400 | B2 | 12/2009 | Chiang | |
| 7,640,633 | B2 * | 1/2010 | Chou | A63B 33/004 24/68 E |
| 7,665,190 | B2 * | 2/2010 | Weng | A63B 33/002 2/426 |
| 7,856,674 | B2 | 12/2010 | Chou | |
| 7,921,476 | B2 | 4/2011 | Chiang | |
| 7,921,523 | B2 | 4/2011 | Chou | |
| 8,042,199 | B2 * | 10/2011 | Chiang | A63B 33/004 2/448 |
| 8,108,973 | B2 | 2/2012 | Chen | |
| 8,117,680 | B1 * | 2/2012 | Chou | A63B 33/004 2/452 |
| 8,230,528 | B2 * | 7/2012 | Chiang | A63B 33/004 24/593.11 |
| 8,286,271 | B2 * | 10/2012 | Chiang | A63B 33/004 2/448 |
| 8,312,603 | B2 * | 11/2012 | Chou | A63B 33/004 24/191 |
| 8,365,363 | B2 | 2/2013 | Chen | |
| 8,407,820 | B1 | 4/2013 | Chou | |
| 8,418,323 | B2 * | 4/2013 | Chou | A63B 33/004 2/909 |
| 8,429,797 | B2 | 4/2013 | Shiue | |
| 8,707,522 | B2 * | 4/2014 | Shiue | A63B 33/002 24/593.11 |
| 8,959,670 | B2 * | 2/2015 | Chiang | A63B 33/004 2/442 |
| 9,241,542 | B2 * | 1/2016 | Kuo | A63B 33/004 |
| 9,332,798 | B2 | 5/2016 | Gafforio et al. | |
| 10,137,036 | B2 * | 11/2018 | Fujimoto | B63C 11/12 |
| 11,912,381 | B2 * | 2/2024 | Fujimoto | B63C 11/12 |
| 2012/0096632 | A1 * | 4/2012 | Chou | A63B 33/004 2/452 |
| 2012/0102631 | A1 | 5/2012 | Lee | |
| 2012/0160989 | A1 * | 6/2012 | Yasuhara | A63B 33/004 248/693 |
| 2022/0061468 | A1 * | 3/2022 | Shiue | A44B 11/006 |
| 2025/0138336 | A1 * | 5/2025 | Osman | A61F 9/027 |

OTHER PUBLICATIONS

"Kayenne—Swim Goggles", Aquasphere, aquasphere.com, Mar. 21, 2024https://web.archive.org/web/20240321044920/https://us.aquasphereswim.com/products/kayenne-swim-goggles.

"V730JASA Youth Swimming Goggles—View", View, view-swim.com, Sep. 22, 2020https://web.archive.org/web/20200922113637/https://view-swim.com/en/products/youth/v730jasa.html.

* cited by examiner

SWIM GOGGLES

TECHNICAL FIELD

The present disclosure relates generally to goggles, and more particularly, to swim goggles.

BACKGROUND

This section provides background information related to the present disclosure which is not necessarily prior art.

Swim goggles are used to isolate a swimmer's eyes from the surrounding water. Conventional swim goggles typically include a pair of spaced-apart eyepieces that are worn over the eyes, a nose band that extends over the nose and connects the eyepieces to one another, and an elastic strap that extends around the rear of the head. Such goggles typically surround the wearer's orbit (eye socket) to protect the eye and improve underwater vision by providing a corneal/air interface instead of exposing the cornea directly to an aqueous environment.

Two important design considerations that drive the design of swim goggles are minimizing hydrodynamic drag and minimizing water entry within the goggle. Hydrodynamic drag creates resistance to the swimmer's forward movement through the water, thereby reducing the swimmer's velocity through the water. Therefore, in order to maximize their velocity when racing or otherwise moving through the water, swimmers desire to reduce water resistance or hydrodynamic drag as much as possible. Reducing hydrodynamic drag is of particular importance in sprinting events, such as the 100-meter freestyle, where time differences between swimmers are frequently measured in fractions of a second. Additionally, during swimming, water may enter a frame of the goggles should the goggles not be sufficiently sealed.

Accordingly, there is a continuing need for new and improved swim goggles, and especially for goggles that minimize hydrodynamic drag and/or minimize water entry within the goggles.

DETAILED DESCRIPTION

The above features and advantages and other features and advantages of the present teachings are readily apparent from the following detailed description of the modes for carrying out the present teachings when taken in connection with the accompanying drawings.

"A," "an," "the," "at least one," and "one or more" are used interchangeably to indicate that at least one of the items is present. A plurality of such items may be present unless the context clearly indicates otherwise. All numerical values of parameters (e.g., of quantities or conditions) in this specification, unless otherwise indicated expressly or clearly in view of the context, including the appended claims, are to be understood as being modified in all instances by the term "about" whether or not "about" actually appears before the numerical value. "About" indicates that the stated numerical value allows some slight imprecision (with some approach to exactness in the value; approximately or reasonably close to the value; nearly). If any imprecision provided by "about" is not otherwise understood in the art with this ordinary meaning, then "about" as used herein indicates at least variations that may arise from ordinary methods of measuring and using such parameters. In addition, a disclosure of a range is to be understood as specifically disclosing all values and further divided ranges within the range. All references referred to are incorporated herein in their entirety.

The terms "comprising," "including," and "having" are inclusive and therefore specify the presence of stated features, steps, operations, elements, or components, but do not preclude the presence or addition of one or more other features, steps, operations, elements, or components. Orders of steps, processes, and operations may be altered when possible, and additional or alternative steps may be employed. As used in this specification, the term "or" includes any one and all combinations of the associated listed items. The term "any of" is understood to include any possible combination of referenced items, including "any one of" the referenced items. The term "any of" is understood to include any possible combination of referenced claims of the appended claims, including "any one of" the referenced claims.

Those having ordinary skill in the art will recognize that terms such as "above," "below," "upward," "downward," "top," "bottom," etc., are used descriptively relative to the figures, and do not represent limitations on the scope of the invention, as defined by the claims.

In the discussion that follows, terms "about," "approximately," "substantially," and the like, when used in describing a numerical value, denote a variation of +/−10% of that value, unless specified otherwise.

Additionally, the goggles are discussed with reference to the orientation when worn by a user of the goggles.

Figure 1:
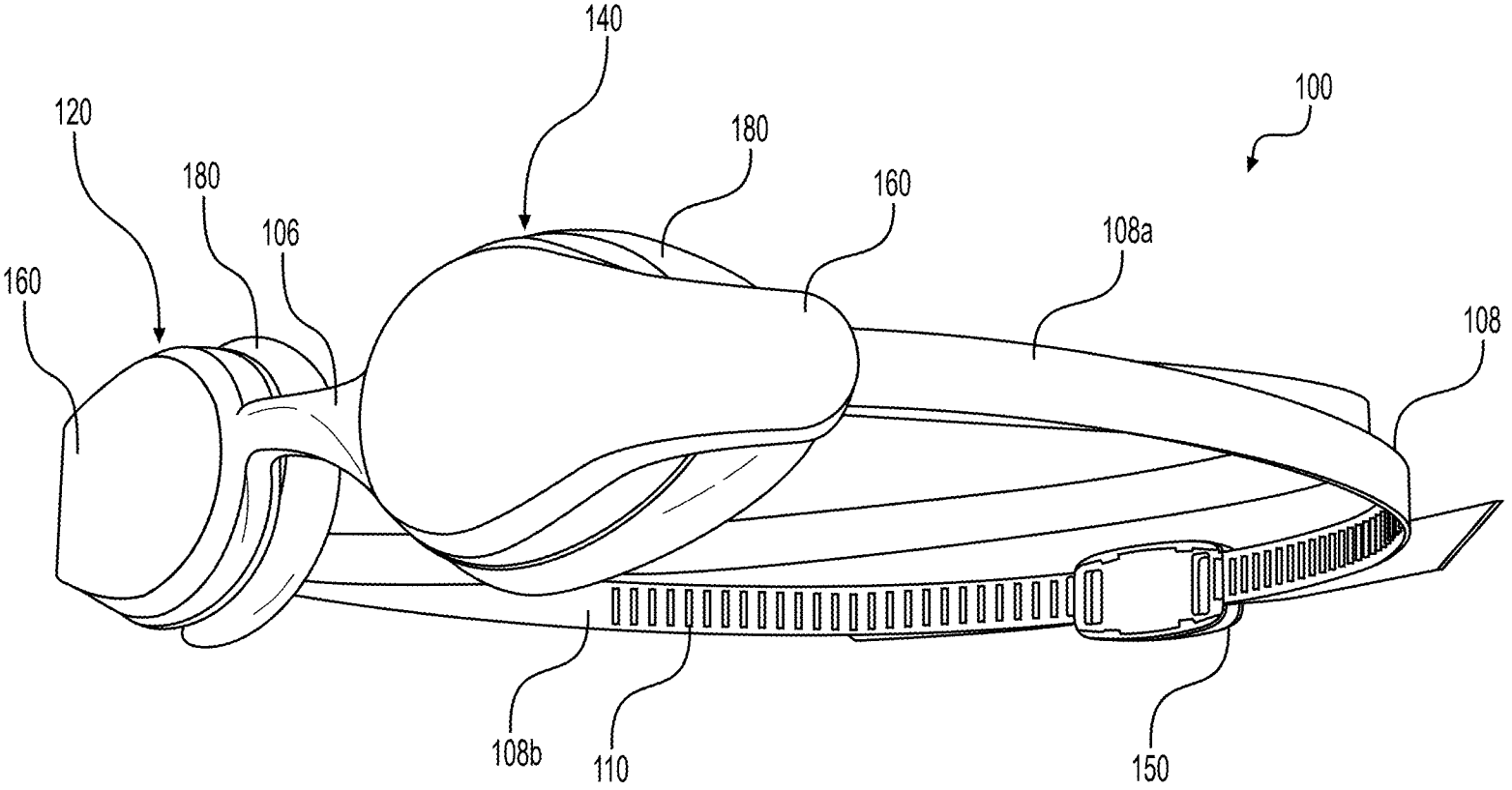
FIG. 1 is a front perspective view of a pair of goggles.
Figure 2A:
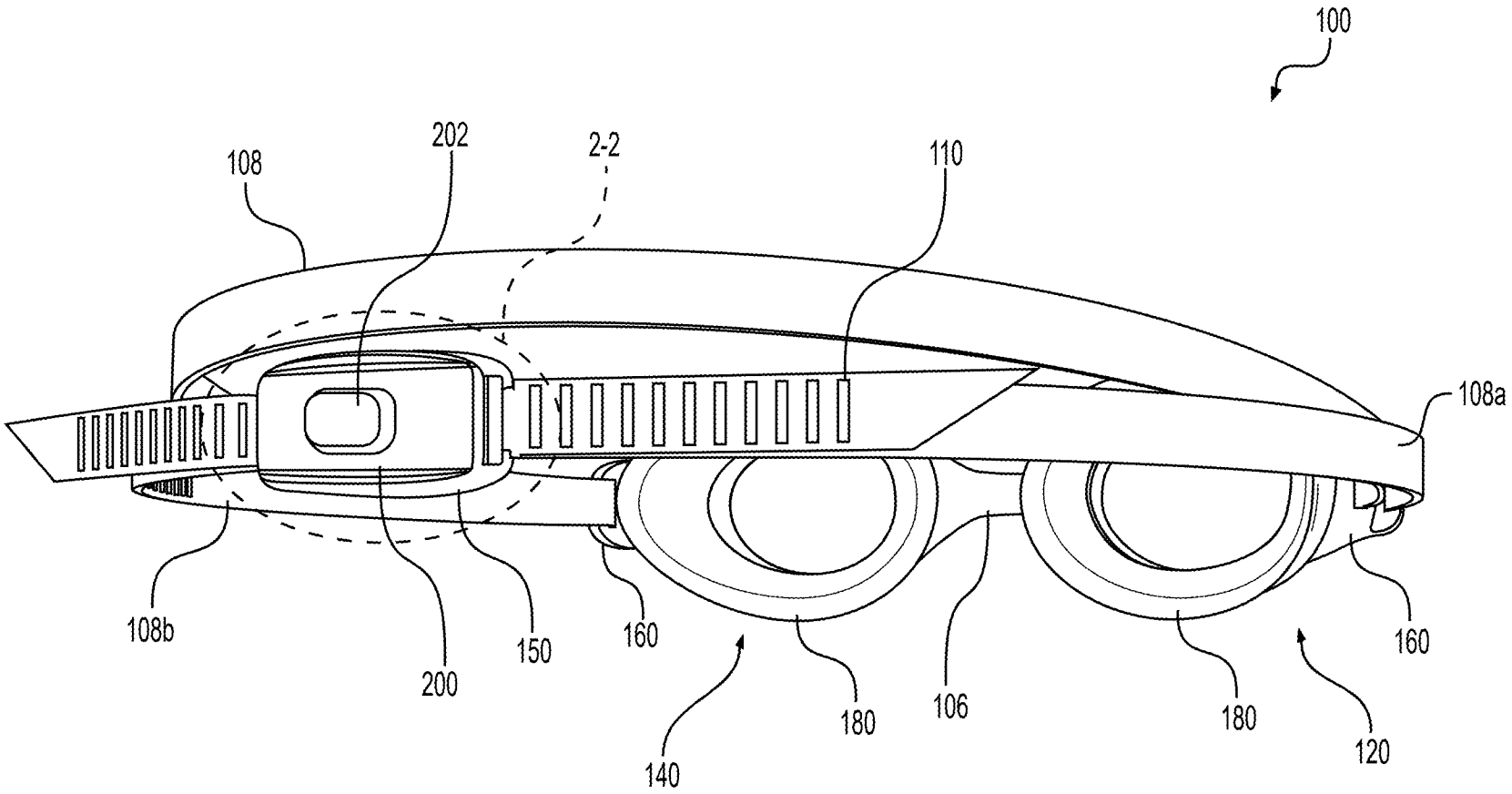
FIG. 2A is a rear view of the goggles shown in FIG. 1.
Figure 2B:
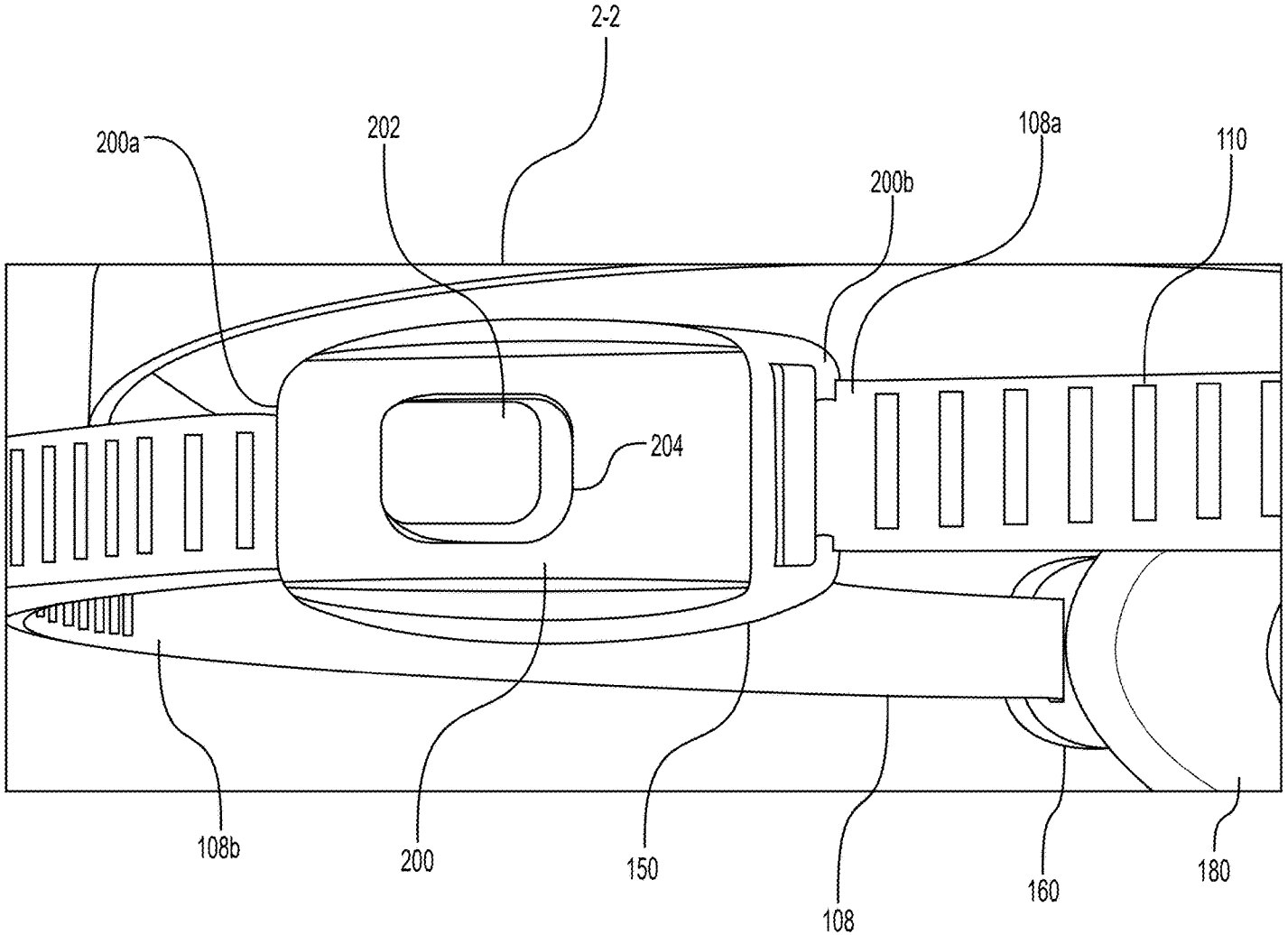
FIG. 2B is an enlargement of the area 2-2 of the goggles shown in FIG. 2A.
Figure 3:
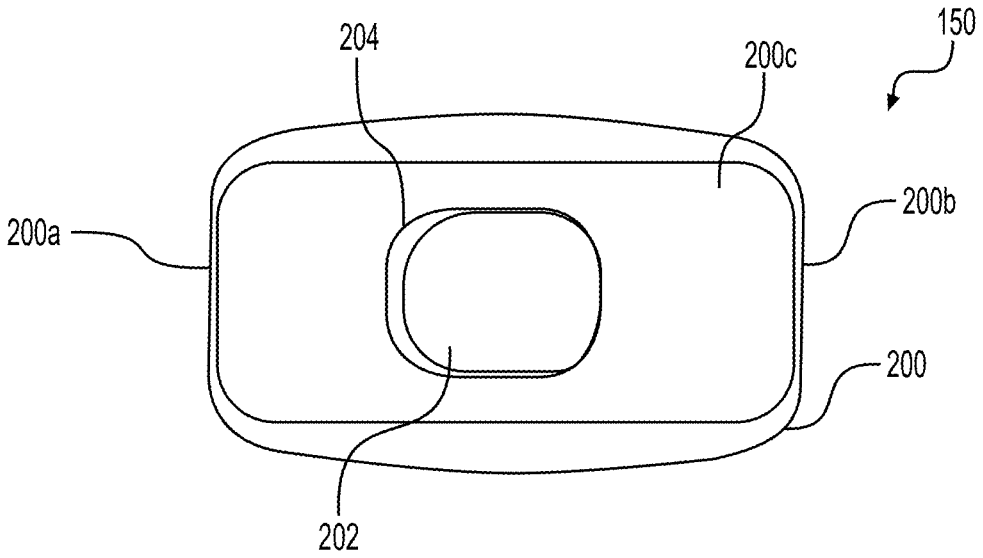
FIG. 3 is a top view of an adjustment mechanism of the goggles of FIG. 1.

FIGS. 1-3 illustrate a set of goggles 100 (commonly referred to as "swim goggles"), according to an example, which includes a first (e.g., right) eyepiece 120 and a second (e.g., left) eyepiece 140, configured to isolate a user's eyes from the surrounding environment. Each eyepiece 120 and 140 comprises a body having a transparent lens portion 160 for covering an eye, and a curved peripheral frame portion or gasket 180 surrounding and supporting the lens portion 160. The curve of the gasket 180 substantially conforms to the contour of a human face from the nose to the orbital rims. The gaskets 180 have respective posterior surfaces or cupped portions that are configured to be placed adjacent the skin of the user.

The gaskets 180 may be formed of an overmolded thermoplastic rubber (TPR). In some examples, the gaskets 180 are formed of a silicone or any other suitable molded plastic which is flexible. Each eyepiece 120 and 140 is constructed from a relatively stiff and hard transparent plastic, with good scratch resistance and optical qualities. A suitable plastic includes an impact-resistant polycarbonate material, although various other materials which are scratch resistant and provide good optical quality may be used.

The eyepieces 120 and 140 can have any of various configurations. In an example, a nose piece 106 interconnects adjacent ends of the eyepieces 120 and 140. In the example, a strap 108 is connected to end portions of respective eyepieces 120 and 140. When worn, strap 108 extends around the rear of the head of the user. Other configurations also can be implemented in the goggles. For example, eyepieces 120 and 140 may be formed as unitary and separate components without nose piece 106 and strap 108.

In another example, each lens portion 160 can be formed with a curved, convex anterior surface. In addition, the lens portions 160 can have various tints or coatings (e.g., an anti-reflection coating). Dimensions of the frame that can be retained by the orbicularis oculi muscles may be determined using many different approaches. For example, the goggles can be custom designed and fitted to a particular individual. Alternatively, the dimensions can be determined by reference to a standard head form that has been designed according to statistical norms from the population, or from published texts and descriptions of such norms.

In an example, each eyepiece 120 and 140 has a one-piece or unitary construction. In an alternative example, the lens portions 160 and the gaskets 180 are separately formed and then subsequently joined together to form the eyepieces 120 and 140. The lens portions 160 can be either permanently attached to the gaskets 180 or connected to the gaskets 180 in a removable manner. In this alternative embodiment, the gaskets 180 need not be constructed from the same material as the lens portions 160.

The set of goggles 100 includes an adjustment mechanism 150. The adjustment mechanism 150 includes a body 200 and a fastener 202. In some examples, the fastener 202 is a button that can be depressed by a user of the goggles 100. In other examples, the fastener 202 may be any device suitable for use in the adjustment mechanism to control tightening and loosening of the goggles 100. The strap 108 is routed through interior portions of the adjustment mechanism 150. The strap 108 is coupled with the adjustment mechanism 150 opposite the eyepieces 120 and 140. The strap 108 includes a first surface 108*a* and a second surface 108*b* disposed opposite the first surface 108*a*. The first surface 108*a* forms an outer portion of the strap 108. The adjustment mechanism 150 is positioned such that the fastener 202 extends away from the first surface 108*a* of the strap 108. The second surface 108*b* forms an inner portion of the strap 108. The strap 108 includes a plurality of teeth 110. The plurality of teeth 110 extends along the second surface 108*b* of the strap 108. The plurality of teeth 110 is disposed opposite the eyepieces 120 and 140. In some examples, the plurality of teeth 110 may be replaced with a plurality of slots depending on the method of attachment and/or adjustment desired between the strap 108 and interior portions of the adjustment mechanism 150. As will be described in greater detail below, the plurality of teeth 110 is configured to engage with interior portions of the adjustment mechanism 150 to tighten and loosen the set of goggles 100.

The adjustment mechanism 150 is a substantially rounded rectangular shape. The adjustment mechanism 150 is configured to transition between a first (free) configuration and a second (locked) configuration. In an example, when the strap 108 is prevented from being adjusted when adjusting the goggles 100, the adjustment mechanism 150 is in the locked configuration. In an example, when the strap 108 is free to be adjusted when adjusting the goggles 100, the adjustment mechanism 150 is in the free configuration. The body 200 extends from a first end 200*a* to a second end 200*b*. The body 200 includes a first surface 200*c* and a second surface 200*d* (shown in FIG. 4) disposed opposite the first surface 200*c*. The first surface 200*c* is an exterior portion of the body 200. The second surface is an interior portion of the body 200. The body 200 of the adjustment mechanism 150 includes an opening 204. The opening 204 is disposed between the first end 200*a* and the second end 200*b*. The opening 204 extends through the first surface 200*c* of the body 200. The fastener 202 extends through the opening 204 of the body 200. The fastener 202 is configured to be depressed by a user of the set of goggles 100. In some examples, the adjustment mechanism 150 may have an ovular shape, square shape, or any other suitable shape for receiving the strap 108 therein and tightening or loosening the goggles 100.

Figure 4:
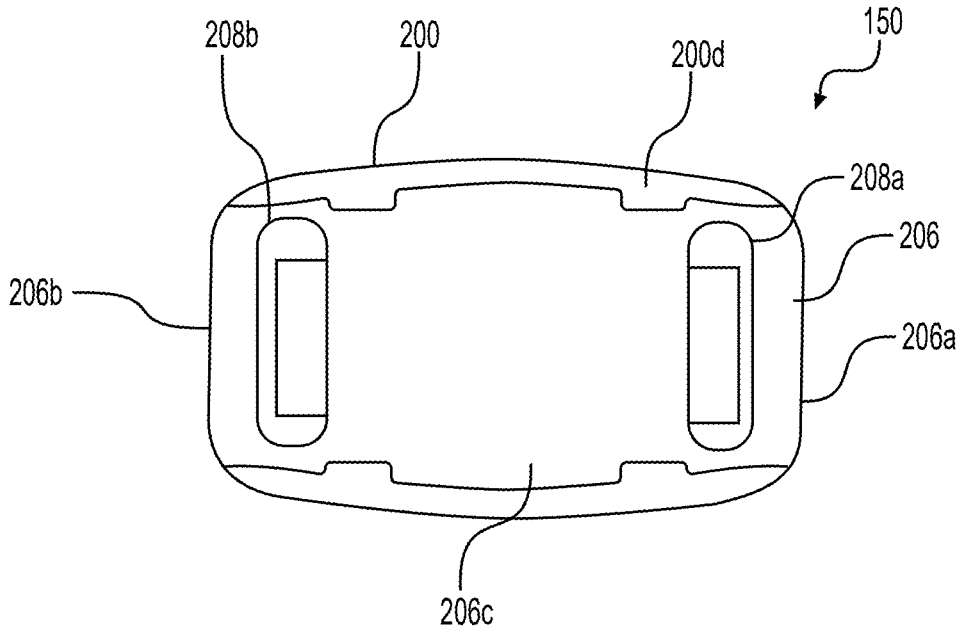
FIG. 4 is a bottom view of the adjustment mechanism of the goggles of FIG. 1.

Referring to FIG. 4, the adjustment mechanism 150 includes a frame 206. The frame 206 is configured to couple with the body 200 to form an outer casing for the adjustment mechanism 150. The frame 206 includes a first end 206*a* and a second end 206*b*. The frame 206 includes a first surface 206*c* and a second surface 206*d* (shown in FIG. 5). The frame 206 includes one or more openings. In an example, the frame 206 includes a first opening 208*a* and a second opening 208*b*. The first opening 208*a* is disposed adjacent the first end 206*a*. The second opening 208*b* is disposed adjacent the second end 206*b*. Each of the first opening 208*a* and the second opening 208*b* extend through the first surface 206*c* of the frame 206. In an example, each of the first opening 208*a* and the second opening 208*b* provide access/visibility into interior portions of the adjustment mechanism 150. In an example, the openings 208*a*, 208*b* have a shape of a rounded rectangle or a pill.

Figure 5:
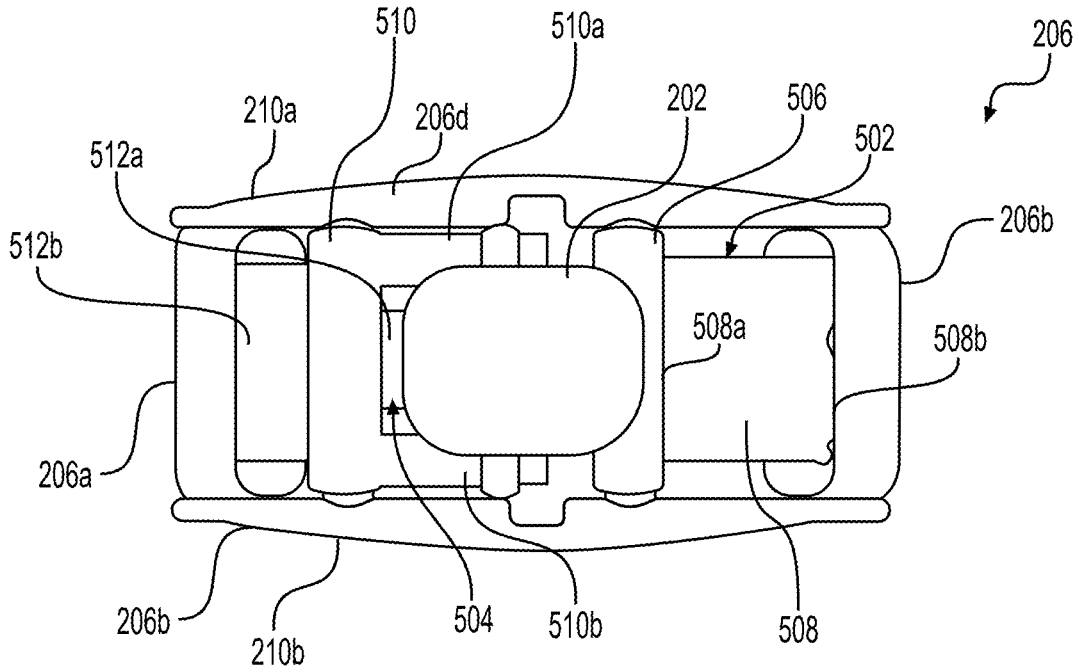
FIG. 5 is a top view of an internal portion of the adjustment mechanism of the goggles shown in FIG. 1.

Referring to FIG. 5, the frame 206 includes a first wall 210*a* and a second wall 210*b*. The frame 206 includes an actuator 502 and a stop 504. Portions of the actuator 502 are configured to be depressed to release and lock the goggles 100. The actuator 502 is coupled with the fastener 202. The actuator 502 includes a rod 506 and a base 508. The rod 506 is integrally formed with portions of the actuator 502. In some examples, the rod 506 may be attached to portions of the actuator 502. In an example, the rod extends from the first wall 210*a* to the second wall 210*b*. The base 508 is integrally formed with the rod 506, but is otherwise unattached to portions of the frame 206. In other words, the base 508 includes a first end 508*a* that is attached to the rod 506 and a second end 508*b* that is free of attachment. The stop 504 is configured to engage with the fastener 202. The stop 504 includes a linkage 510. The linkage 510 includes a first arm 510*a* and a second arm 510*b*. The first arm 510*a* is disposed adjacent to the first wall 210*a*. The second arm 510*b* is disposed adjacent to the second wall 210*b*. The first arm 510*a* extends away from the linkage 510 toward the second end 206*b* of the frame 206. The second arm 510*b* extends away from the linkage 510 toward the second end 206*b* of the frame 206. The linkage 510 includes a first flange 512*a* and a second flange 512*b*. The first flange 512*a* is configured to engage with the fastener 202 to restrict movement of the fastener 202. The second flange 512*b* extends from the linkage 510 toward the first end 206*a* of the frame 206. In an example, the first flange 512*a* has a width that is smaller or less than a width of the second flange 512*b*.

Figure 6:
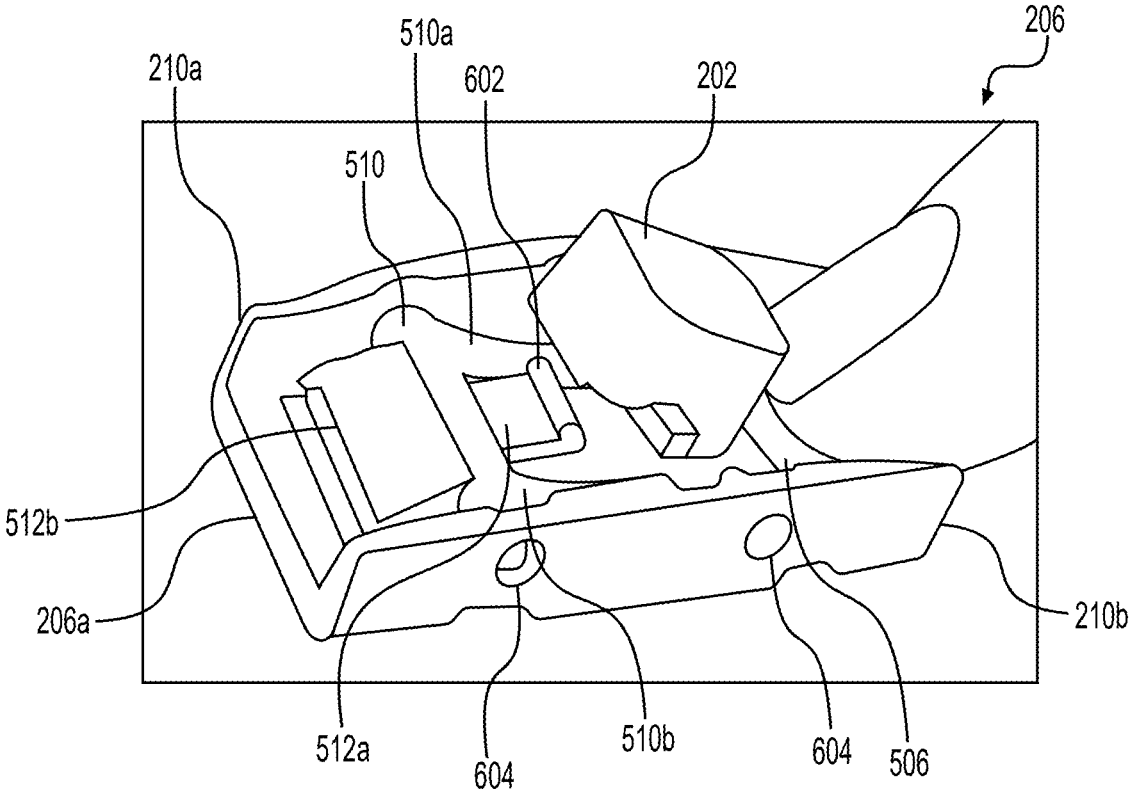
FIG. 6 is a top perspective view of an internal portion of the adjustment mechanism of the goggles shown in FIG. 1.

FIG. 6 depicts the actuator 502 in the first configuration. The first flange 512*a* of the stop 504 includes a lip 602 that is configured to engage with the fastener 202. The frame 206 includes one or more openings 604. The one or more openings 604 are disposed in the second wall 210*b* of the frame 206. The lip 602 engages an underside of the fastener 202. In an example, the fastener 202 includes a lip, ledge, or opening configured to engage with the lip 602. In the first configuration, the fastener 202 is depressed to allow the base 508 and the flange 512*b* to move and allow for movement of the strap 108. As the fastener 202 is depressed, the fastener 202 acts (e.g., pushes, moves, pivots, etc.) on the first flange 512*a* to move the linkage 510 and the second flange 512*b*. For example, the linkage 510 moves (e.g., pivots or rotates) relative to the first wall 210*a* and the second wall 210*b* to move the second flange 512*b* toward the fastener 202. In the second configuration, the fastener 202 is engaged with the lip 602 to prevent movement of the strap 108. In an example, the teeth 110 of the strap 108 engage with one or both of the base 508 and the flange 512*b* as the strap 108 is pulled through the openings 208*a*, 208*b* of the frame 206.

The present adjustment mechanism 150 includes interior components which are manufactured as a singular frame 206. That is, the frame 206 of the adjustment mechanism 150 is made of the same material and is one unitary component rather than being assembled with separate components. This reduces the number of moving parts within the adjustment mechanism 150 and reduces the points of failure of the adjustment mechanism 150. For example, in some instances the adjustment mechanism 150 does not include any springs. In an example, the adjustment mechanism 150, and more specifically the frame 206, is made by additive manufacturing (e.g., 3D printing or the like). In some examples, the adjustment mechanism 150 is comprised of a unitary construction such that the adjustment mechanism 150 is not divided into a frame and a body.

In an example, the adjustment mechanism 150 is comprised entirely of a single material. In an example, the adjustment mechanism 150 is comprised of plastic. In other examples, the adjustment mechanism 150 is comprised of a plurality of materials that are suitable for manufacturing an adjustment mechanism 150 that reduces the number of moving parts.

The detailed description and the drawings or figures are supportive and descriptive of the present teachings, but the scope of the present teachings is defined solely by the claims. While some of the best modes and other embodiments for carrying out the present teachings have been described in detail, various alternative designs and embodiments exist for practicing the present teachings defined in the appended claims.

While various embodiments have been described, the description is intended to be exemplary, rather than limiting and it will be apparent to those of ordinary skill in the art that many more embodiments and implementations are possible that are within the scope of the embodiments. Any feature of any embodiment may be used in combination with or substituted for any other feature or element in any other embodiment unless specifically restricted. Accordingly, the embodiments are not to be restricted except in light of the attached claims and their equivalents. Also, various modifications and changes may be made within the scope of the attached claims. Benefits, other advantages, and solutions to problems, and any element or elements that may cause any benefit, advantage, or solution to occur or become more pronounced, however, are not to be construed as critical, required, or essential features or elements of any or all of the claims, unless such benefits, advantages, solutions, or elements are expressly stated in such claims.

The following clauses provide an exemplary configuration for an article of footwear and sole structure described above.

Clause 1. Swim goggles comprising: a strap; and an adjustment mechanism including a body and a frame both together forming an outer casing of the adjustment mechanism, the frame including an actuator and a stop, wherein the strap is routed through the adjustment mechanism.

Clause 2. The goggles of Clause 1, wherein the frame includes a fastener, and wherein the body includes an opening.

Clause 3. The goggles of Clause 2, wherein the fastener extends through the opening of the body, and wherein the fastener is configured to be pushed to transition the adjustment mechanism between a first configuration and a second configuration.

Clause 4. The goggles of Clause 1, wherein the body of the adjustment mechanism is comprised of a first material, and the frame of the adjustment mechanism is comprised of a second material, and wherein the first material and the second material are the same.

Clause 5. The goggles of Clause 1, wherein the frame of the adjustment mechanism is integrally formed.

Clause 6. The goggles of Clause 1, wherein the frame of the adjustment mechanism is formed by additive manufacturing.

Clause 7. The goggles of Clause 2, wherein the frame extends from a first end to a second end, the frame including a first wall and a second wall disposed opposite the first wall.

Clause 8. The goggles of Clause 7, wherein the actuator includes: a base extending from a first end to a second end; and a rod attached to the first end of the base, the rod extending from the first wall to the second wall.

Clause 9. The goggles of Clause 8, wherein the second end of the base is a free end that is unattached to portions of the actuator and the frame.

Clause 10. The goggles of Clause 7, wherein the stop includes: a linkage extending from the first wall to the second wall, the linkage including a first arm disposed adjacent the first wall and a second arm disposed adjacent the second wall.

Clause 11. The goggles of Clause 10, wherein the linkage includes a first flange extending from the linkage and a second flange extending from the linkage opposite the second flange, the first flange being configured to engage the fastener via a lip.

Clause 12. The goggles of Clause 11, wherein the first flange includes a first width and the second flange includes a second width, the first width of the first flange being less than the second width of the second flange.

Clause 13. Swim goggles comprising: a strap, the strap including a plurality of teeth; and an adjustment mechanism including a body and a frame forming an outer casing of the adjustment mechanism, the body comprised of a first material and the frame comprised of a second material, wherein the first material of the body and the second material of the frame are the same.

Clause 14. The goggles of Clause 13, wherein the first material is plastic and the second material is plastic.

Clause 15. The goggles of Clause 13, wherein the frame includes: an actuator comprising: a base extending from a first end to a second end; and a rod attached to the first end of the base, the rod extending from a first wall of the frame to a second wall of the frame; a fastener attached to the rod opposite the base; and a stop comprising: a linkage extending from the first wall of the frame to the second wall of the frame, the linkage including a first arm disposed adjacent the first wall and a second arm disposed adjacent the second wall; and a first flange extending from the linkage and a second flange extending from the linkage opposite the second flange.

Clause 16. The goggles of Clause 15, wherein the first flange includes a lip that is configured to engage with the fastener.

Clause 17. The goggles of Clause 15, wherein the body includes an opening, and wherein the fastener extends through the opening of the body.

Clause 18. The goggles of Clause 15, wherein the strap extends through the adjustment mechanism and the plurality of teeth are configured to engage the base of the actuator and the second flange of the stop.

Clause 19. The goggles of Clause 13, wherein the adjustment mechanism is manufactured via additive manufacturing.

Clause 20. An adjustment mechanism including: a body extending from a first end to a second end, the body including an opening disposed between the first end and the second end; and a frame, configured to releasably couple to the body, extending from a first end to a second end, the frame including: a first wall and a second wall disposed opposite the first wall, each of the first wall and the second wall extending from the first end of the frame to the second end of the frame; an actuator disposed adjacent the first end of the frame, the actuator comprising: a base extending from a first end to a second end; and a rod attached to the first end of the base, the rod extending from the first wall of the frame to the second wall of the frame; and a fastener attached to the rod opposite the base, the fastener extending through the opening of the base; and a stop disposed adjacent the second end of the frame, the stop comprising: a linkage extending from the first wall of the frame to the second wall of the frame, the linkage including a first arm disposed adjacent the first wall and a second arm disposed adjacent the second wall; and a first flange extending from the linkage and a second flange extending from the linkage opposite the second flange, wherein each of the rod of the actuator and the linkage of the stop are integrally formed with the first wall of the frame and the second wall of the frame.

Clause 21. Swim goggles including the adjustment mechanism of Clause 20.

We claim:

1. Swim goggles comprising:

a strap; and an adjustment mechanism configured to transition between a first configuration and a second configuration, the adjustment mechanism including:

a body including an exterior having an outermost face, an interior, and an opening, the opening extending through the outermost face of the exterior to expose the interior; and a frame including a fastener extending from the interior of the body to the exterior of the body, through the opening of the body and the outermost face of the body, wherein the frame and the body both together form an outer casing of the adjustment mechanism, the frame including:

an actuator, wherein a portion of the actuator is coupled with the fastener; and a stop, the stop including:

a linkage including a first arm and a second arm, the linkage including a first flange and a second flange opposite the first flange, the first flange including a lip, the lip being engaged with an underside of the fastener in the first configuration and being disengaged from the underside of the fastener in the second configuration, wherein the strap is routed through the adjustment mechanism.

2. The goggles of claim 1, wherein the body of the adjustment mechanism is comprised of a first material, and the frame of the adjustment mechanism is comprised of a second material, and wherein the first material and the second material are the same.

3. The goggles of claim 1, wherein the frame of the adjustment mechanism is integrally formed.

4. The goggles of claim 1, wherein the frame of the adjustment mechanism is formed by additive manufacturing.

5. The goggles of claim 1, wherein the frame extends from a first end to a second end, the frame including a first wall and a second wall disposed opposite the first wall.

6. The goggles of claim 5, wherein the actuator includes:

a base extending from a first end to a second end; and a rod attached to the first end of the base, the rod extending from the first wall to the second wall.

7. The goggles of claim 6, wherein the second end of the base is a free end that is unattached to portions of the actuator and the frame.

8. The goggles of claim 1, wherein the first flange includes a first width and the second flange includes a second width, the first width of the first flange being less than the second width of the second flange.

9. The goggles of claim 1, wherein the adjustment mechanism is a rounded rectangular shape.

10. Swim goggles comprising:

a strap, the strap including a plurality of teeth; and an adjustment mechanism including:

a body including a first surface and a second surface disposed opposite the first surface, the first surface of the body includes an opening; and a frame including a first surface and extending from a first end to a second end, the frame including a first opening disposed adjacent the first end and formed in the first surface, and a second opening disposed adjacent the second end and formed in the first surface, the frame including:

an actuator comprising:

a base extending from a first end to a second end, the second end of the base being a free end of the base and free of other portions of the adjustment mechanism; and a rod attached to the first end of the base, the rod extending from a first wall of the frame to a second wall of the frame, the base extending toward the second end of the frame;

a fastener attached to the rod opposite the base, the base extending toward the first end of the frame; and a stop comprising:

a linkage extending from the first wall of the frame to the second wall of the frame, the linkage including a first arm disposed adjacent the first wall and a second arm disposed adjacent the second wall; and a first flange extending from the linkage and a second flange extending from the linkage opposite the second flange, the second flange extending over the second opening of the frame, wherein the frame and the body form an outer casing of the adjustment mechanism, the body comprised of a first material and the frame comprised of a second material, wherein the first material of the body and the second material of the frame are the same.

11. The goggles of claim 10, wherein the first material is plastic and the second material is plastic.

12. The goggles of claim 10, wherein the first flange includes a lip that is configured to engage with the fastener.

13. The goggles of claim 10, wherein the fastener extends through the opening of the body.

14. The goggles of claim 10, wherein the strap extends through the adjustment mechanism and the plurality of teeth are configured to engage the base of the actuator and the second flange of the stop.

15. The goggles of claim 10, wherein the adjustment mechanism is manufactured via additive manufacturing.

16. The goggles of claim 10, wherein each of the first opening and the second opening allow visibility into interior portions of the adjustment mechanism.

* * * * *